US005736427A

United States Patent [19]

Henderson

[11] Patent Number: 5,736,427

[45] Date of Patent: Apr. 7, 1998

[54] POLISHING PAD CONTOUR INDICATOR FOR MECHANICAL OR CHEMICAL-MECHANICAL PLANARIZATION

[75] Inventor: Gary O. Henderson, Boise, Id.

[73] Assignee: Micron Technology, Inc., Boise, Id.

[21] Appl. No.: 727,021

[22] Filed: Oct. 8, 1996

[51] Int. Cl.[6] ..... H01L 21/00

[52] U.S. Cl. ..... 438/14; 156/345; 216/84; 216/88; 438/8; 438/692; 438/747

[58] Field of Search ..... 216/38, 84, 85, 216/88, 89, 90, 91; 156/345 LC, 345 LP; 438/8, 14, 691, 692, 693, 747

[56] References Cited

U.S. PATENT DOCUMENTS

| | | | |
|---|---|---|---|
| 4,793,895 | 12/1988 | Kaanta et al. | 156/345 |
| 5,081,421 | 1/1992 | Miller et al. | 216/88 |
| 5,635,083 | 6/1997 | Breivogel et al. | 216/88 |

*Primary Examiner*—William Powell
*Attorney, Agent, or Firm*—Seed and Berry LLP

[57] ABSTRACT

A contour indicator that visually indicates non-uniformities in the planarity of the planarizing surface of a polishing pad. In one embodiment of the invention, a polishing pad has a polishing body with a planarizing surface facing the wafer and a contour indicator embedded in the polishing body. The contour indicator is preferably the material of the polishing body dyed to a color or shade that is visually distinguishable from the polishing body. The contour indicator preferably has first and second sidewalls spaced apart from one another at the planarizing surface of the polishing body, and the contour indicator also has a cross-sectional shape so that the distance between the first and second sidewalls changes with increasing the depth within the pad. In operation, the distance between the first and second sidewalls of the contour indicator changes as material is removed from the planarizing surface, and the distance between the first and second sidewalls at the planarizing surface indicates the contour of the planarizing surface.

46 Claims, 4 Drawing Sheets

POLISHING PAD CONTOUR INDICATOR FOR MECHANICAL OR CHEMICAL-MECHANICAL PLANARIZATION

TECHNICAL FIELD

The present invention relates to polishing pads used in chemical-mechanical planarization of semiconductor wafers, and more particularly to a contour indicator that visually denotes non-uniformities in the planarity of the planarizing surface of a polishing pad.

BACKGROUND OF THE INVENTION

Chemical-mechanical planarization ("CMP") processes remove material from the surface of a semiconductor wafer in the production of integrated circuits. FIG. 1 schematically illustrates a CMP machine 10 with a platen 20, a wafer carrier 30, a polishing pad 40, and a planarizing liquid 44 on the polishing pad 40. The polishing pad 40 may be a conventional polishing pad made from a continuous phase matrix material (e.g., polyurethane), or it may be a new generation fixed-abrasive polishing pad made from abrasive particles fixedly dispersed in a suspension medium. The planarizing liquid 44 may be a conventional CMP slurry with abrasive particles and chemicals that remove material from the wafer, or the planarizing liquid 44 may be a planarizing solution without abrasive particles. In most CMP applications, conventional CMP slurries with abrasive particles are used on conventional polishing pads, and planarizing solutions without abrasive particles are used on fixed-abrasive polishing pads.

The CMP machine 10 also has an under pad 25 attached to an upper sin-face 22 of the platen 20 and the lower surface of the polishing pad 40. In one type of CMP machine, a drive assembly 26 rotates the platen 20 as indicated by arrow A. In another type of CMP machine, the drive assembly reciprocates the platen back and forth as indicated by arrow B. Since the polishing pad 40 is attached to the under pad 25, the polishing pad 40 moves with the platen 20.

The wafer carrier 30 has a lower surface 32 to which a wafer 12 may be attached, or the wafer 12 may be attached to a resilient pad 34 positioned between the wafer 12 and the lower surface 32. The wafer carrier 30 may be a weighted, free-floating wafer carrier, or an actuator assembly 315 may be attached to the wafer carrier to impart axial and/or rotational motion (indicated by arrows C and D, respectively).

To planarize the wafer 12 with the CMP machine 10, the wafer carrier 30 presses the wafer 12 face-downward against a planarizing surface 42 of the polishing pad 40. While the face of the wafer 12 presses against the polishing pad 40, at least one of the platen 20 or the wafer carrier 30 moves relative to the other to move the wafer 12 across the planarizing surface 42. As the face of the wafer 12 moves across the planarizing surface 42, the polishing pad 40 and the planarizing liquid 44 continually remove material from the face of the wafer 12.

CMP processes must consistently and accurately produce a uniform, planar surface on the wafer to enable precise circuit and device patterns to be formed with photolithography techniques. As the density of integrated circuits increases, it is often necessary to accurately focus the critical dimensions of the photo-patterns to within a tolerance of approximately 0.1 μm. Focusing photo-patterns of such small tolerances, however, is difficult when the planarized surface of the wafer is not uniformly planar. Thus, CMP processes must create a highly uniform, planar surface.

One problem with CMP processes is that the surface of the wafer may not be uniformly planar because the rate at which the thickness of the wafer decreases (the "polishing rate") often varies from one area on the wafer to another. The polishing rate is a function of several factors, one of which is the local pressure between the pad and the wafer across the face of the wafer. The local pressure between the pad and the wafer typically varies because the planarizing surface of the pad may not be uniformly planar. Moreover, even if the planarizing surface of the pad is planar at one point in time, the contour of the planarizing surface changes over time because one portion of the pad may wear at a different rate than another. For example, pad conditioning processes that remove material from the planarizing surface may inadvertently remove more material from one portion of the planarizing surface than another. Therefore, it is desirable to measure the contour of the pad throughout the CMP process, and then either re-condition the pad to enhance the planarity of the pad, adjust the pressure between the wafer and the pad to compensate for the topography of the pad, or discard the pad if the contour of the pad is excessively non-uniform.

Several types of devices have been developed to measure the contour of the planarizing surface of polishing pads. One existing device for measuring the contour of the planarizing surface of a polishing pad is an arm-type stylus with a needle-like tip attached to a pivotable arm. In operation, the tip follows the contour of the pad as the stylus moves across the surface of the pad. The tip causes the arm to pivot about a pivot point so that the angular deflection of the arm is proportional to the change in the contour of the pad. Another existing device for measuring the contour of the polishing surface is an interferometer. Interferometers typically direct a laser beam at the planarizing surface and measure a phase change between the original beam and the beam reflected from the planarizing surface. By knowing the wavelength of the laser beam, the phase change indicates the linear displacement from one point on the pad to another.

Current contour measuring devices present several manufacturing concerns for CMP processing. One problem with existing measuring devices is that they are not well suited for easily indicating the contour of the polishing surface in real-time while the polishing pad is being conditioned or a wafer is being planarized. Real-time contour measurements are desirable to eliminate the down-time associated with stopping the conditioning or CMP processes to measure the contour of the surface of the pad. Real-time contour measurements are also desirable because the contour of a pad may change while a wafer is being conditioned. However, it is difficult to accurately measure the contour of the pad in real-time with conventional measuring devices. Interferometers, for example, may generate inaccurate real-time measurements because the light beam may reflect off of the slurry, or conditioning solution instead of the planarizing surface of the pad. Arm-type styluses may also generate inaccurate real-time measurements because the arm has a relatively large mass compared to the tip. Thus, after the tip passes over a sharp rise in the polishing surface, the upward momentum of the arm may cause the tip to momentarily disengage the pad and produce a false reading.

Another problem with conventional contouring measuring devices is that they require relatively sensitive and expensive equipment. Interferometers and stylus measuring devices require sensitive, precise components to accurately measure the contour of a polishing pad. Additionally, position sensors and computers are also necessary to correlate the displacement measurements with the exact locations on the polishing pad at which the measurements were made.

Therefore, conventional contour measuring devices increase the cost of manufacturing semiconductor devices.

In light of the problems associated with conventional polishing pad contour measuring devices, it would be desirable to develop a device for indicating the contour of the planarizing surface of a polishing pad in real-time while the polishing pad is being conditioned. Additionally, it would be desirable to reduce costs associated with measuring the contour of the planarizing surface of a polishing pad.

SUMMARY OF THE INVENTION

The present invention is a contour indicator that visually indicates non-uniformities in the planarity of the planarizing surface of a polishing pad. In one embodiment of the invention, a polishing pad has a polishing body with a planarizing surface facing the wafer and a contour indicator embedded in the polishing body. The contour indicator is preferably the material of the polishing body dyed to a color or shade that is visually distinguishable from the polishing body. The contour indicator preferably has first and second sidewalls spaced apart from one another at the planarizing surface of the polishing body, and the contour indicator preferably also has a cross-sectional shape so that the distance between the first and second sidewalls changes with increasing the depth within the pad. In operation, the space between the first and second sidewalls of the contour indicator changes as material is removed from the planarizing surface, and the distance between the first and second sidewalls at the planarizing surface indicates the contour of the planarizing surface.

In another embodiment, a polishing pad has a polishing body with a primary section and a visually distinguishable secondary section embedded in the primary section. The secondary section has a top surface substantially coplanar with a planarizing surface of the primary section, and the secondary section has a cross-sectional shape with a contour indicating dimension that changes with increasing depth within the primary section in a manner in which the shape of an exposed surface of the secondary section indicates the contour of the pad. The change of the cross-sectional shape of the secondary section is preferably such that the shape of the exposed surface of the secondary section has an expected shape when the planarizing surface is uniformly planar. In operation, a shape of the exposed surface other than the expected shape indicates non-uniformities in the planarity of the planarizing surface.

In still another embodiment of tile invention, a planarizing machine for chemical-mechanical planarization of a semiconductor wafer has a platen mounted to a support structure, a polishing pad positioned on the platen, and a wafer carrier to which the wafer may be mounted. The polishing pad includes a polishing body having a planarizing surface facing the wafer and a visually distinguishable contour indicator embedded in the polishing body. The contour indicator has a top surface substantially coplanar with a portion of the planarizing surface of the polishing body, and the contour indicator has a bottom surface extending to at least an intermediate depth within the polishing body. The top surface and the bottom surface together define a cross-sectional shape that changes with increasing depth within the pad in a maimer in which the shape of an exposed surface of the contour indicator indicates the contour of the planarizing surface of the pad. More specifically, the exposed surface of the contour indicator preferably has an expected shape when the planarizing surface is uniformly planar. In operation, the wafer carrier engages the wafer with the planarizing surface of the polishing pad, and at least one of the platen or the wafer carrier then moves with respect to the other to impart relative motion between the wafer mid the polishing pad. Since the contour of the planarizing surface often changes during CMP processing or conditioning, the shape of the exposed surface of the contour indicator indicates non-uniformities in the planarizing surface when it is different than the expected shape at a planar surface.

DETAILED DESCRIPTION OF THE INVENTION

The present invention is a contour indicator that visually denotes non-uniformities in the planarity of the planarizing surface of a polishing pad. An important aspect of an embodiment of the invention is that the contour indicator is visually distinguishable from the rest of the polishing pad. Another important aspect of an embodiment of the invention is that the cross-sectional shape of the contour indicator has a contour indicating dimension that changes with increasing depth within the pad body in a manner in which the shape of an exposed surface of the contour indicator indicates the contour of the planarizing surface. As a result, an exposed surface of the contour indicator with a shape other than an expected shape at a uniformly planar surface indicates non-uniformities in the contour of the planarizing surface of the polishing pad. FIGS. 2–7B, in which like reference numbers refer to like parts, illustrate various polishing pads and contour indicators in accordance with the invention.

Figure 1:
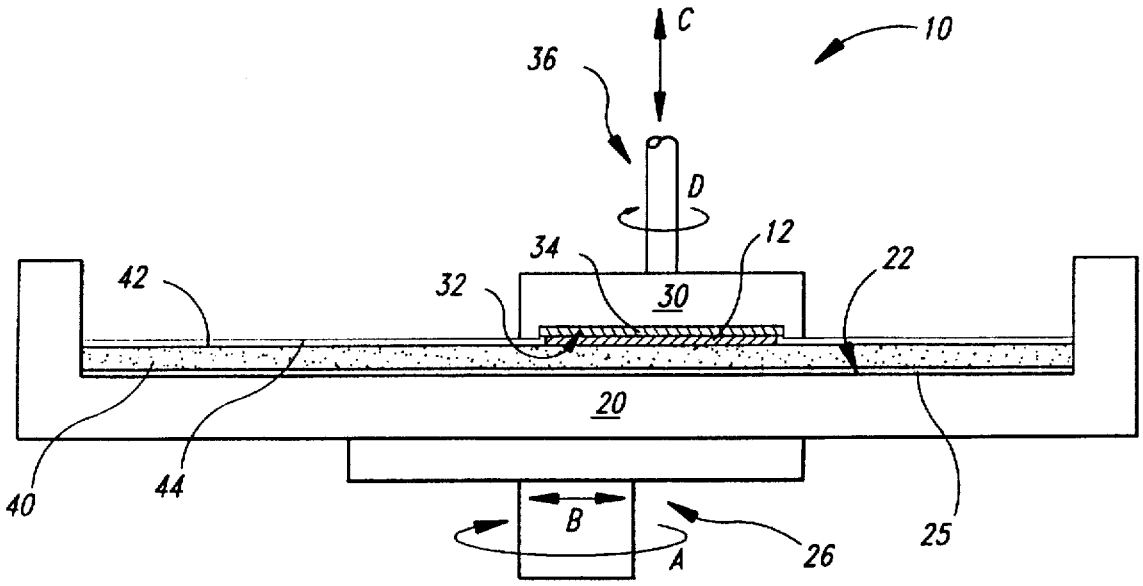
Fig. 1 (Prior Art)
FIG. 1 is a schematic cross-sectional view of a planarizing machine for chemical-mechanical planarization of semiconductor wafers in accordance with the prior art.
Figure 2:
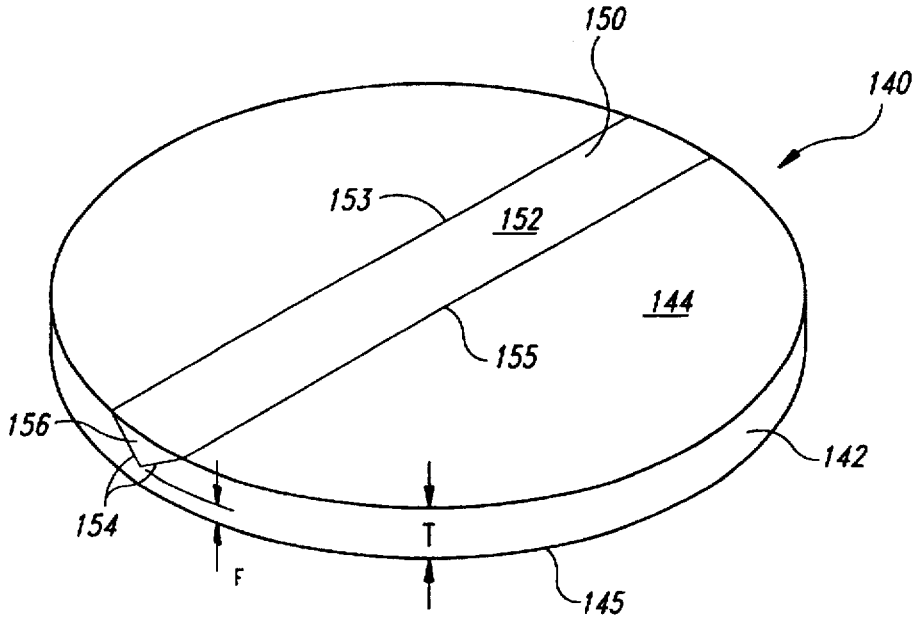
FIG. 2 is an isometric view of a polishing pad with a contour indicator in accordance with the invention.

FIG. 2 is an isometric view of an embodiment of a polishing pad 140 in accordance with the invention. The polishing pad 140 has a polishing body 142 and a high-contrast contour indicator 150 embedded or otherwise formed in the polishing body 142. The polishing body 142 is preferably a primary section of the pad 140 with a planarizing surface 144 and a bottom surface 145 that are separated by a thickness T. The planarizing surface 144 is generally conditioned by abrading the polishing body 142 with a diamond-embedded disk that removes material from the planarizing surface 144. The thickness T of the polishing body 142 accordingly decreases until it is reduced to a final thickness $T_F$ at the end of the useful life of the polishing pad 140. The polishing body 142 may be a substantially non-abrasive material such as felt, polyurethane, or other known non-abrasive polishing pad materials. The polishing body 142 may also be a fixed-abrasive material having a suspension medium and a substantially uniform distribution of abrasive particles fixedly bonded to the suspension medium.

Figure 3:
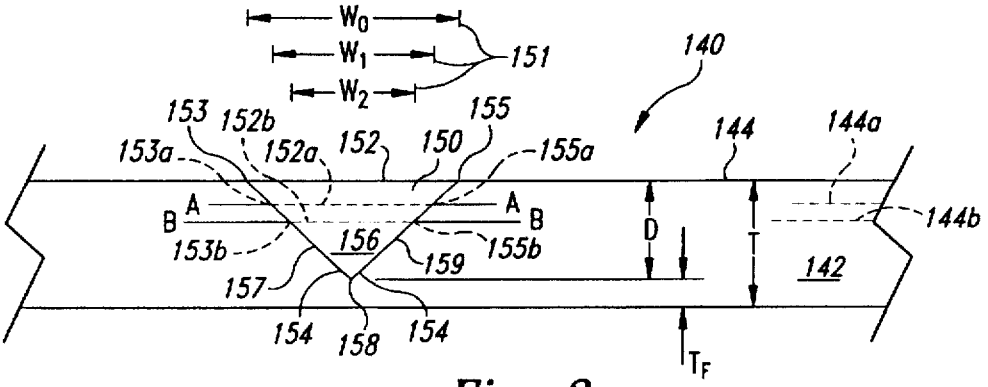
FIG. 3 is a partial cross-sectional view of a polishing pad with a contour indicator in accordance with the invention.

FIG. 3 is a partial cross-sectional view of the polishing pad 140 that further illustrates the contour indicator 150 and the polishing body 142. The contour indicator 150 is preferably a filler or secondary section of the pad 140 with a top surface 152 substantially co-planar with the planarizing surface 144 of the polishing body 142. The top surface 152 of the contour indicator 150 extends across at least a portion of the planarizing surface 144 of the polishing body 142, and the top surface 152 has a contour indicating dimension 151 with an original width $W_0$ defined by the distance between a first edge 153 and a second edge 155 at the planarizing surface 144. The first and second edges 153 and 155 are preferably substantially parallel to one another so that the original width $W_0$ of tile contour indicating dimension 15 1 is the same along the length of the contour indicator 150. In other embodiments, the first and second edges 153 and 155 may not be parallel to one another, but rather they may extend across the planarizing surface 144 convergently or divergently with respect to one another. Thus, the top surface 152 of the contour indicator 150 may have many different shapes, and the contour indicating dimension 151 may be virtually any single dimension or all of the dimensions of the shape of the particular top surface 152.

The contour indicator 150 also has a bottom sin-face 154 that extends to an intermediate depth D within the polishing body 142. The bottom surface 154 and top surface 152 define a cross-sectional shape 156 in which the contour indicating dimension 151 changes with increasing depth within the polishing body 142 in a manner in which the shape of an exposed surface of the contour indicator provides an indication of the contour of the planarizing system. The bottom surface 154 of the contour indicator 150 preferably has a lowermost point 158 such that the depth D of the contour indicator 150 is at the final thickness $T_F$ corresponding to the endpoint of the life of the polishing pad 140. As discussed in detail below, the contour indicator 150 indicates both the endpoint of the pad 140 and non-uniformities in the planarity of the pad 140.

Referring still to FIG. 3, the bottom surface 154 preferably has a first sidewall 157 and a second sidewall 159 extending convergently towards one another from the first edge 153 and second edge 155, respectively. The distance between the first and second sidewalls 157 and 159 preferably changes uniformly and symmetrically with increasing depth within the polishing body 142 such that the contour indicating dimension 151 has a width $W_1$ at level A—A within the polishing body 142 and a width $W_2$ at level B—B within the polishing body 142. The contour indicating dimension 151 at an intermediate plane 152(*a*) through the contour indicator 150 parallel to the top surface 152 at level A—A is accordingly defined by a first edge 153(*a*) and a second edge 155(*a*) spaced apart by the width $W_1$. If the pad 140 was conditioned to expose the internal plane 152(*a*) and the exposed surface was uniformly planar, the exposed surface would have an expected shape in which the first and second edges 153(*a*) and 155(*a*) are parallel to one another across the width $W_1$ for the length of the contour indicator 150. Similarly, the contour indicating dimension 151 at a second intermediate plane 152(*b*) parallel to the top surface 152 at level B—B is defined by a first edge 153(*b*) and a second edge 155(*b*) spaced apart by the width $W_2$. Also, if the pad 140 was conditioned to expose the surface at the second internal plane 152(*b*) and the exposed surface was uniformly planar, the exposed surface at plane 152(*b*) would have an expected shape in which the first and second edges 153(*b*) and 155(*b*) are parallel to one another across the width $W_2$ for the length of the contour indicator 150. Accordingly, as the thickness T of the polishing pad 140 changes during CMP processing or conditioning, an exposed surface of the contour indicator 150 with a shape other than an expected shape at a uniformly planar surface indicates non-uniformities in the contour of the planarizing surface 144 of the polishing body 142.

The contour indicator 150 is preferably made from the same material as that of the polishing body 142, or it may be made from another material that wears similarly to the material of the polishing body 142. The contour indicator 150 accordingly wears at the same rate as the polishing body 142 so that the contour of the top surface 152 along the length of the contour indicator 150 is the same as the contour of the planarizing surface 144 of the polishing body 142 next to the contour indicator 150. The contour indicator 150 is also stained or dyed to a shade or color that is visually distinguishable from that of the polishing body 142. In a preferred embodiment, the contour indicator 150 has a very high contrast shade or color with respect to the color of the polishing body 142.

Figure 4:
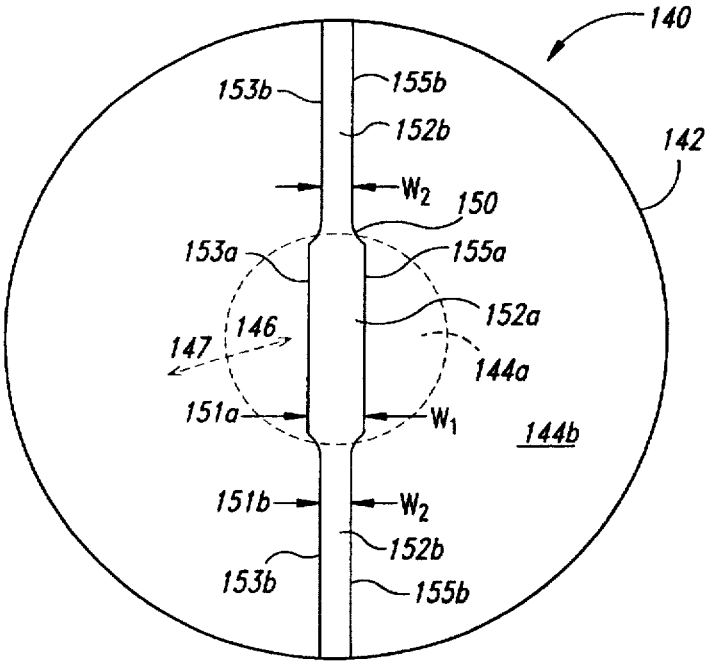
FIG. 4 is a top view of a polishing pad with a contour indicator in accordance with the invention.
Figure 5:
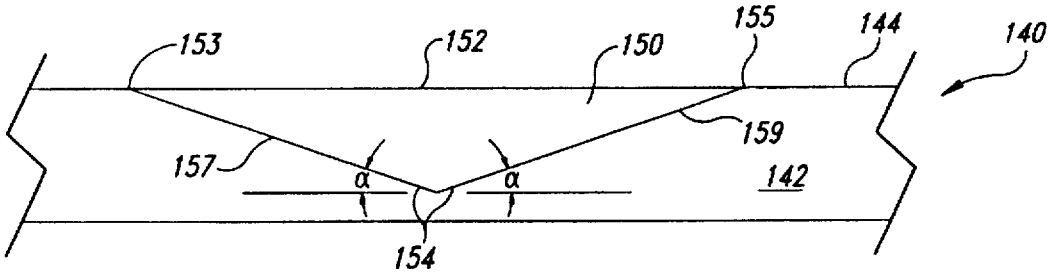
FIG. 5 is a partial cross-sectional view of another polishing pad with a contour indicator in accordance with the invention.

FIG. 4 is a top plan view of the polishing pad 140 that illustrates an example of the operation of the contour indicator 150 of FIGS. 2 and 3. After the polishing pad 140 is conditioned or otherwise wears down from CMP processing, the polishing pad 140 may have a contour in which an inner region 146 has a planarizing surface 144(*a*) at elevation A—A (shown in FIG. 3) and an outer region 147 with a planarizing surface 144(*b*) at elevation B—B (shown in FIG. 3). The shape of the top surface of the contour indicator 150 changes non-uniformly from the single set of parallel edges 153 and 155 (shown in FIG. 2) to a top surface 152(*a*) at level A—A in the inner region 146 and a top surface 152(*b*) at level B—B in the outer region 147. The top surface 152(*a*) has a contour indicating dimension 151(*a*) defined by first and second edges 153(*a*) and 155(*a*) separated by the width $W_1$, and the top surface 152(*b*) has a contour indicating dimension 15 1(*b*) defined by first and second edges 153(*b*) and 155(*b*) separated by the width $W_2$. The shape of the exposed surface of the contour indicator, therefore, is not the expected shape with parallel edges along the length of the contour indicator 150. The contour indicator 150 accordingly indicates that the planarizing surface 142 of the polishing pad 140 is not uniformly planar. Additionally, since the cross section of the contour indicator 150 decreases with increasing depth (shown in FIG. 3), the narrow top surface 152(*b*) is thus lower than the wide top surface 152(*a*).

One advantage of the contour indicator and polishing pad of the preferred embodiment of the present invention is that non-uniformities in the contour of the polishing pad are indicated in real-time as a wafer is planarized or the polishing pad is conditioned. By providing a contour indicator that is visually distinguishable form the body of the polishing pad, and by changing the cross section of the contour indicator with increasing depth of the polishing pad in a manner in which an exposed surface of the contour indicator indicates the contour of the planarizing surface, the shape of an exposed surface of the contour indicator indicates the contour of the planarizing surface of the polishing pad. Therefore, the preferred embodiment of the present invention indicates the relative contour of the planarizing surface of the polishing pad at any time during the CMP or conditioning processes.

Another advantage of the preferred embodiment of the present invention is that it indicates the relative contour of the planarizing surface of the polishing pad without using expensive instruments. Unlike interferometers or stylus contour measuring devices, the contour of the planarizing surface is indicated with polishing pad material dyed to visually contrast with the material of the polishing body. Thus, not only are capital expenditures reduced for contour measuring devices, but the maintenance costs of maintaining and calibrating such precise equipment are also reduced. Therefore, the costs associated with CMP processing are generally reduced.

In addition to the embodiment of the contour indicator 150 shown in FIGS. 2–4, FIG. 5 is a partial cross-sectional view of the polishing pad 140 in which the sensitivity of the contour indicator 150 is adjusted by reducing the slope of the bottom surface 154 of the contour indicator 150. More specifically, the sensitivity of the contour indicator 150 is increased by decreasing an angle $\alpha$ of the first and second sidewalls 157 and 159 with respect to the planarizing surface 144. It will be appreciated that the width between the first and second edges 153 and 155 changes more per unit depth by reducing the angle $\alpha$. Accordingly, smaller vertical non-uniformities in the contour of the planarizing surface 144 are indicated by conditioning indicators 150 that have sidewalls 157 and 159 with relatively gradual slopes.

Figure 6A:
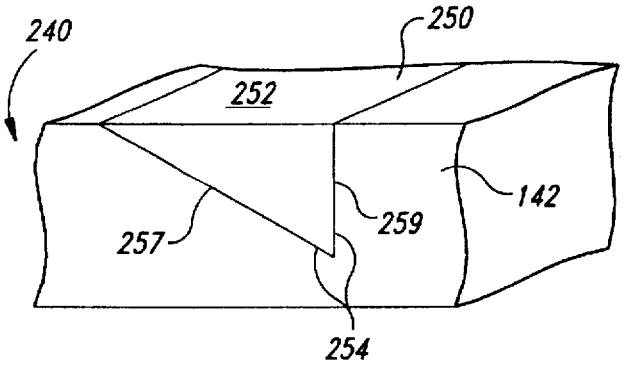
FIG. 6A is a partial isometric view of a polishing pad with another contour indicator in accordance with the invention.
Figure 6B:
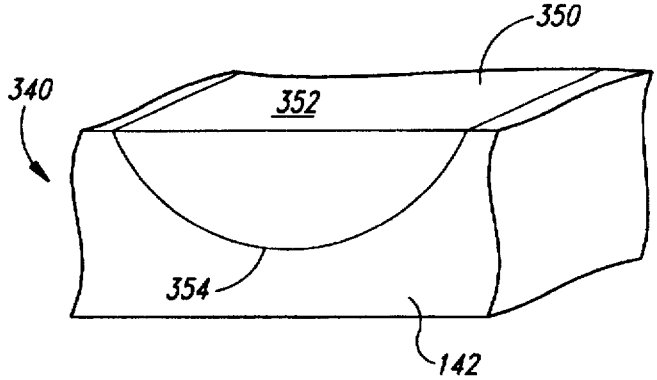
FIG. 6B is a partial isometric view of a polishing pad with another contour indicator in accordance with the invention.
Figure 6C:
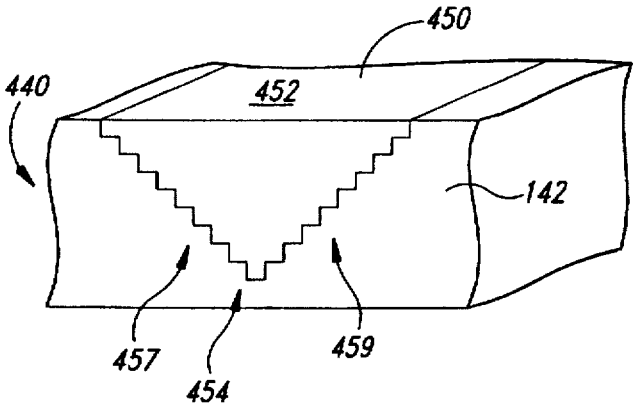
FIG. 6C is a partial isometric view of a polishing pad with another contour indicator in accordance with the invention.
Figure 6D:
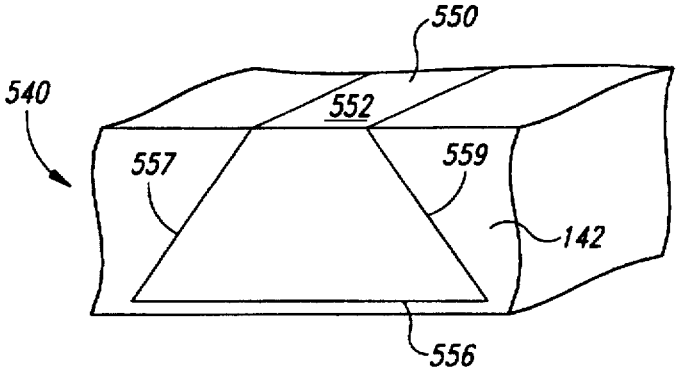
FIG. 6D is a partial isometric view of a polishing pad with another contour indicator in accordance with the invention.

Several other embodiments of contour indicators in accordance with the invention are shown in FIGS. 6A–6D. FIG. 6A illustrates a polishing pad 240 in which a contour indicator 250 has a triangular cross section defined by a top surface 252 and a bottom surface 254. More specifically, the bottom surface 254 has a sloped first sidewall 257 and a substantially vertical second sidewall 259. FIG. 6B illustrates another polishing pad 340 in which the contour indicator 350 has a curved cross section defined by a top surface 352 and a bottom surface 354. The bottom surface 354 of the contour indicator 350 is a symmetrical curve such as an arc of a circle, ellipse, or a parabolic shape. FIG. 6C illustrates a polishing pad 440 in which a contour indicator 450 has a bottom surface 454 shaped in a series of steps 457 and 459 progressing convergently downwardly with increasing depth within the pad. FIG. 6D illustrates a polishing pad 540 in which a contour indicator 550 has a trapezoidal cross section with a horizontal bottom surface 556 form which first and second sidewalls 557 and 559 extend convergently upwardly to a top surface 552.

The cross-sectional shapes of the contour indicators 150–550 illustrated in FIGS. 2 and 6A–6D are exemplary of cross-sectional shapes for contour indicators in accordance with the invention. It will be appreciated that other cross-sectional shapes of contour indicators are within the scope of the invention. Accordingly, virtually any cross-sectional shape that changes with increasing depth in the polishing body 142 is within the scope of the invention. In general, cross-sectional shapes of contour indicators of the invention preferably have parallel sidewalls that form parallel edges between the contour indicator and the polishing pad where the shape of the top surface of the planarizing surface is uniformly planar.

Figure 7A:
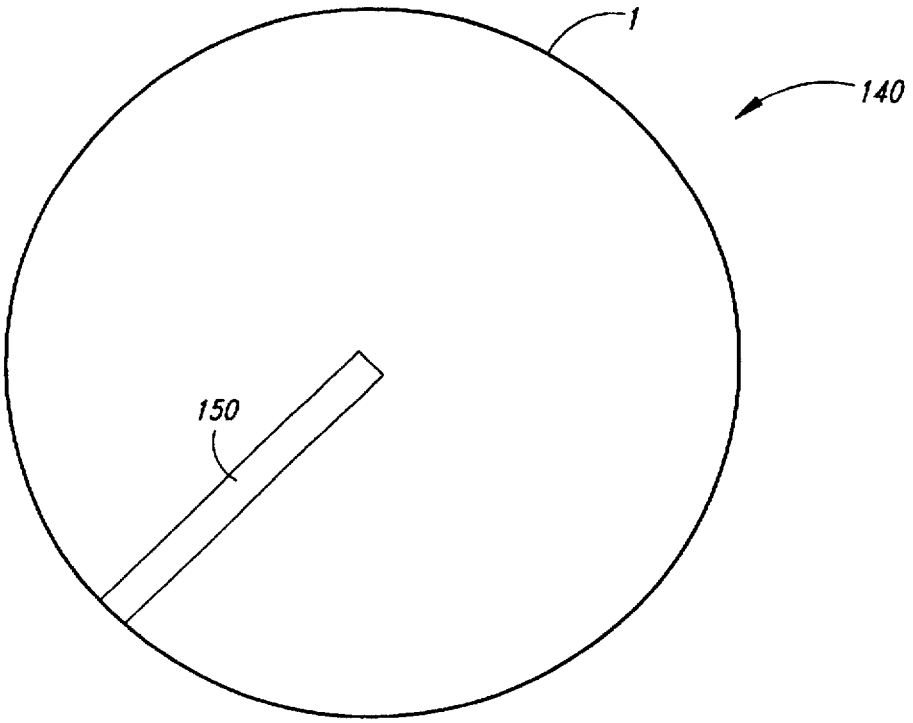
FIG. 7A is a top view of another polishing pad with a contour indicator in accordance with the invention.
Figure 7B:
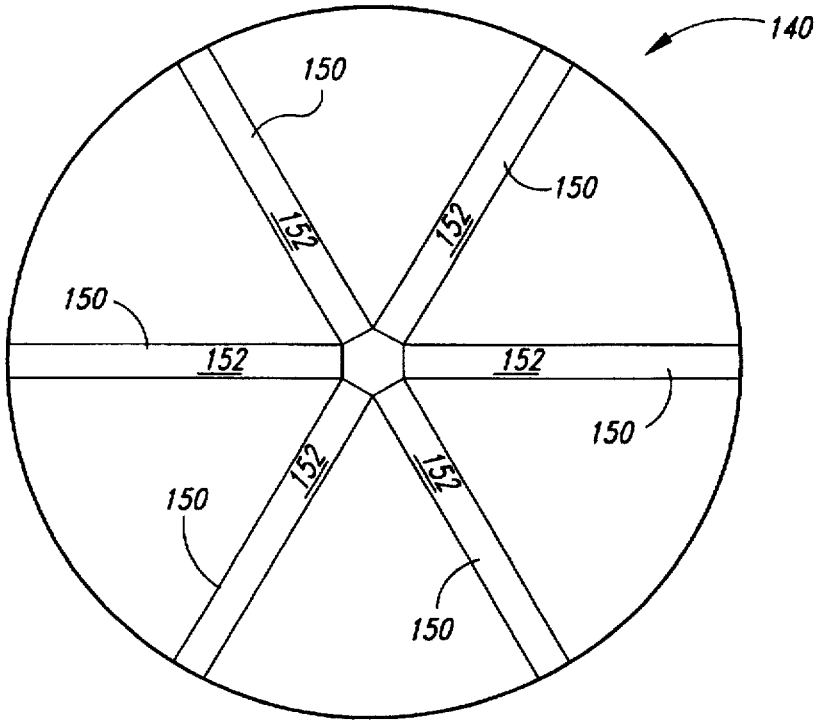
FIG. 7B is a top view of another polishing pad with a contour indicator in accordance with the invention.

FIGS. 7A and 7B illustrate various embodiments of polishing pads with different configurations of contour indicators. Referring to FIG. 7A, the polishing pad 140 has a contour indicator 150 that extends along a radius of the polishing pad 140. Referring to FIG. 7B, the polishing pad 140 has a plurality of contour indicators 150 extending along radii of the polishing pad 140. Accordingly, the present invention is not limited to a single conditioning indicator on a diameter of the polishing pad 140 as shown in FIG. 2. Furthermore, the contour indicators may have shapes other than radially oriented strips across a polishing pad, e.g., one or more circular contour indicators centered about the center of the polishing pad 140 in a pattern of concentric rings in which the multiple contour indicators have different diameters. In still another example, a three dimensional geometric shape such as a circle or polygon may be positioned on one side of the polishing pad 140 between the center and perimeter of the pad.

A polishing pad and contour indicator in accordance with the invention are preferably made by cutting the polishing body of the polishing pad from an uncured cake of polishing pad material, and then cutting a channel through at least a portion of the polishing body. The channel has a cross-sectional shape that is the same as the desired cross-sectional shape of the contour indicator, and the channel preferably has a depth within the body at the desired endpoint of the pad life. The channel is then filled with dyed pad material that is in a flowable state. The body and the dyed pad material are then cured, and the dyed pad material is subsequently cut to a planar surface across the body of the polishing pad. Another embodiment for making a polishing pad and contour indicator in accordance with the invention is to cut a channel in a body section having the cross-sectional shape of the contour indicator, and then adhering a preformed strip of dyed pad material into the channel.

From the foregoing it will be appreciated that, although specific embodiments of the invention have been described herein for purposes of illustration, various modifications may be made without deviating from the spirit and scope of the invention. Also, although the various embodiments of the inventive polishing pad are described as being used for polishing semiconductor wafers, it will be understood that they may be used to polish other types of substrates, such as field emission display baseplates. Accordingly, the invention is not limited except as by the appended claims.

I claim:

1. A polishing pad for planarizing a surface of a substrate, comprising:

a polishing body having a planarizing surface facing the substrate; and a contour indicator embedded in the polishing body and extending across at least a portion of the polishing body, the contour indicator being visually distinguishable from the polishing body, and the contour indicator having first and second sidewalls spaced apart from one another within the polishing body to define a cross-sectional shape in which a width between the first and second sidewalls changes with respect to the depth of the pad, wherein the planarizing surface changes as the pad is conditioned and the width between the sidewalls at the planarizing surface indicates a contour of the planarizing surface of the polishing pad.

2. The polishing pad of claim 1 wherein the first and second sidewalls of the contour indicator extend to a depth within the polishing body corresponding to a useful life of the polishing pad.

3. The polishing pad of claim 1 wherein first and second sidewalls of the contour indicator are spaced apart at the planarizing surface of the polishing body and extend convergently towards one another to a depth within the polishing body.

4. The polishing pad of claim 3 wherein the cross-sectional shape of the contour indicator is triangular.

5. The polishing pad of claim 3 wherein the cross-sectional shape of the contour indicator is an equilateral triangle with a apex at a depth within the polishing body corresponding to a useful life of the polishing pad.

6. The polishing pad of claim 5 wherein an angle between one of the first and second sidewalls and the planarizing surface is between approximately 60° and 15°.

7. The polishing pad of claim 3 wherein the cross-sectional shape of the contour indicator is trapezoidal.

8. The polishing pad of claim 3 wherein the cross-sectional shape of the contour indicator is a symmetrical curve with an apex at a lowermost point within the polishing body, and wherein the first sidewall defines one-half of the symmetrical curve from the apex to the planarizing surface and the second sidewall defines another one-half of the symmetrical curve from the apex to the planarizing surface.

9. The polishing pad of claim 1 wherein the first and second sidewalls of the contour indicator extend divergently from the planarizing surface to a depth within the polishing body.

10. The polishing pad of claim 9 wherein the cross-sectional shape of the contour indicator is triangular.

11. The polishing pad of claim 9 wherein the cross-sectional shape of the polishing pad is trapezoidal.

12. The polishing pad of claim 9 wherein the cross-sectional shape of the polishing pad is a symmetrical curve.

13. The polishing pad of claim 1 wherein the polishing body has a circular planarizing surface and the contour indicator extends across a diameter of the polishing body.

14. The polishing pad of claim 13 wherein the polishing body has a circular planarization surface and the contour indicator extends across a plurality of diameters of the polishing body.

15. The polishing body of claim 1 wherein the polishing body has a circular planarizing surface and the contour indicator extends across a radius of the polishing body.

16. The polishing body of claim 1 wherein the polishing body has a circular planarizing surface and the contour indicator extends across a plurality of radii of the polishing body.

17. The polishing body of claim 1 wherein the polishing body and the contour indicator are the same material, the contour indicator being dyed to a color different than that of the polishing body.

18. The polishing body of claim 1 wherein the polishing body and the contour indicator are the same material, the contour indicator being dyed to a shade of color different than that of the polishing body.

19. A polishing pad for planarizing a surface of a substrate, comprising:

a polishing body having a planarizing surface facing the substrate; and a visually distinguishable filler section embedded in the polishing body, the filler section having a top surface coplanar with a portion of the planarizing surface of the polishing body and a bottom surface extending to at least an intermediate depth within the polishing body, the top surface and the bottom surface defining a cross-sectional shape having a contour indicating dimension that changes with increasing depth within the filler section in a manner in which a shape of an exposed surface of the filler section indicates the contour of the planarizing surface.

20. The polishing body of claim 19 wherein the filler section has first and second sidewalls extending to a depth within the polishing body.

21. The polishing body of claim 20 wherein the first and second sidewalls are spaced apart at the planarizing surface of the polishing body and extend convergently to a depth within the polishing body corresponding to a useful life of the pad.

22. The polishing body of claim 20 wherein the first and second sidewalls extend divergently frown the planarizing surface to a depth within the body.

23. The polishing body of claim 19 wherein the contour indicating dimension has spaced apart parallel first and second edges along uniformly planar portions of the planarizing surface, and wherein a non-planar change of the planarizing surface produces a non-parallel orientation between the first and second edges.

24. A polishing pad for planarizing a surface of a substrate, comprising a primary section and a secondary section embedded in the primary section, the secondary section being visually distinguishable from the primary section, and the secondary section having a contour indicating dimension of a first size at a top surface substantially coplanar with a planarizing surface of the primary section and a cross-sectional shape in which the contour indicating dimension changes with increasing depth within the pad to a second size at a plane extending through the secondary section substantially parallel the top surface at an intermediated depth, wherein an exposed surface of the secondary section at the intermediate depth in which the contour indicating dimension has a size different than the second size indicates a non-uniform contour of the planarizing surface of the polishing pad.

25. The polishing body of claim 24 wherein the secondary section has first and second sidewalls extending to a depth within the primary section.

26. The polishing body of claim 25 wherein the first and second sidewalls are spaced apart at the planarizing surface of the primary section and extend convergently to a depth within the primary section.

27. The polishing body of claim 25 wherein the first and second sidewalls extend divergently from the planarizing surface to a depth within the primary section corresponding to a useful life of the polishing pad.

28. The polishing body of claim 24 wherein the top surface has a shape in which the contour indicating dimension is defined by spaced apart parallel first and second edges along uniformly planar portions of the planarizing surface, and wherein a non-planar change of the planarizing surface produces a non-parallel orientation between the first and second edges.

29. The polishing pad of claim 24 wherein the primary section has a circular planarizing surface and the secondary section extends across a diameter of the primary section.

30. A planarizing machine for chemical-mechanical planarization of a semiconductor wafer, comprising:

a platen mounted to a support structure;

a polishing pad including a polishing body with a primary section and a secondary section embedded in the primary section, the secondary section being visually distinguishable from the primary section, and the secondary section having a top surface substantially coplanar with a planarizing surface of the primary section and a cross-sectional shape having a contour indicating dimension that changes with increasing depth within the secondary section in a manner in which a shape of an exposed surface of the secondary section indicates the contour of the planarizing surface; and a wafer carrier to which the wafer may be mounted, the wafer carrier being positionable over the planarizing surface of the polishing pad and adapted to engage the wafer with the planarizing surface of the polishing pad, wherein at least one of the platen and the wafer carrier moves with respect to the other to impart relative motion between the wafer and the polishing pad.

31. The polishing body of claim 20 wherein the secondary section has first and second sidewalls extending to a depth within the primary section.

32. The polishing body of claim 31 wherein the first and second sidewalls are spaced apart at the planarizing surface of the primary section and extend convergently to a depth within the primary section.

33. The polishing body of claim 31 wherein the first and second sidewalls extend divergently from the planarizing surface to a depth within the primary section corresponding to a useful life of the polishing pad.

34. The polishing body of claim 30 wherein the top surface has a shape in which the contour indicating dimension is defined by spaced apart parallel first and second edges along uniformly planar portions of the planarizing surface, and wherein a non-planar change of the planarizing surface produces a non-parallel orientation between the first and second edges.

35. The polishing pad of claim 30 wherein the primary section has a circular planarizing surface and the secondary section extend across a diameter of the primary section.

36. A method for detecting a contour of a planarizing surface of a polishing pad used in mechanical or chemical-mechanical planarization of a substrate, the method comprising the steps of:

providing a polishing body and a visually distinctive contour indicator embedded in the polishing body so that a top surface of the contour indicator is substantially coplanar with a planarizing surface of the polishing body and a bottom surface of the contour indicator extends to at least an intermediate depth within the polishing body, wherein the contour indicator has a cross section with a contour indicating dimension that changes with increasing depth within the pad in a manner in which a shape of an exposed surface of the contour indicator indicates the contour of the planarizing surface; and detecting a shape of a conditioned surface of the contour indicator to determine a relative contour of the planarizing surface of the polishing pad.

37. The method of claim 36 wherein the contour indicating dimension is defined by spaced apart parallel first and second edges along uniformly planar portions of the planarizing surface, and wherein the detecting step comprises denoting a non-parallel change in orientation between the first and second edges.

38. The method of claim 36 wherein contour indicator extends to a depth within the polishing body corresponding to a useful life of the polishing pad, and wherein the method further comprises changing-out the polishing pad when the planarizing surface is below the depth of the contour indicator.

39. A method for selective conditioning of a polishing pad used in mechanical or chemical-mechanical planarization of a substrate, the method comprising the steps of:

providing a polishing body and a visually distinctive contour indicator embedded in the polishing body so that a top surface of the contour indicator is substantially coplanar with a planarizing surface of the polishing body and a bottom surface of the contour indicator extends to at least an intermediate depth within the polishing body, wherein the contour indicator has a cross section with a contour indicating dimension that changes with increasing depth within the pad in a manner in which a shape of an exposed surface of the contour indicator indicates the contour of the planarizing surface;

removing a portion of the planarizing surface from the polishing pad to bring the planarizing surface into a desired state for planarizing the substrate; and detecting a shape of a conditioned surface of the contour indicator to determine a relative contour of the planarizing surface of the polishing pad.

40. The method of claim 39 wherein the contour indicating dimension is defined by spaced apart parallel first and second edges along uniformly planar portions of the planarizing surface, and wherein the detecting step comprises denoting a non-parallel change in orientation between the first and second edges.

41. The method of claim 40, further comprising repeating the removing step over high areas of the planarizing surface where a non-parallel changes in orientation between the first and second edges indicates the planarizing surface is relatively higher than other areas on the planarizing surface.

42. The method of claim 39 wherein contour indicator extends to a depth within the polishing body corresponding to a useful life of the polishing pad, and wherein the method further comprises changing-out the polishing pad when the planarizing surface is below the depth of the contour indicator.

43. A method for chemical-mechanical planarization of a semiconductor wafer, the method comprising the steps of:

providing a polishing pad including a polishing body and a visually distinctive contour indicator embedded in the polishing body so that a top surface of the contour indicator is substantially coplanar with a planarizing surface of the polishing body and a bottom surface of the contour indicator extends to at least an intermediate depth within the polishing body, wherein the contour indicator has a cross section with a contour indicating dimension that changes with increasing depth within the pad in a manner in which a shape of an exposed surface of the contour indicator indicates the contour of the planarizing surface;

pressing the wafer against the polishing pad; and moving at least one of the wafer and the polishing pad with respect to the other to impart relative motion therebetween.

44. The method of claim 43 wherein the contour indicating dimension is defined by spaced apart parallel first and second edges along uniformly planar portions of the planarizing surface, and wherein the method further comprises detecting a non-parallel change in orientation between the first and second edges.

45. The method of claim 44, further comprising removing material from high areas of the planarizing surface where a non-parallel change in orientation between the first and second edges indicates the planarizing surface is relatively higher than other areas on the planarizing surface.

46. A polishing pad for planarizing a surface of a substrate, comprising:

a polishing body having a planarizing surface facing the substrate; and a contour indicator embedded in the polishing body and extending for a length across at least a portion of the polishing body, the contour indicator being visually distinguishable from the polishing body, and the contour indicator having first and second side walls spaced apart from one another within the pad to define a cross-sectional shape in which a contour indicating dimension changes with respect to the depth of the pad, wherein the contour indicating dimension at a uniformly planar exposed surface of the contour indicator is uniform along the length of the contour indicator so that exposed edges of the first and second side walls at the exposed surface are parallel to one another.

* * * * *